United States Patent [19]

Zuhlsdorff et al.

[11] 3,967,630

[45] July 6, 1976

[54] BRISTLE HAIR CURLER AND HAIR CURLER MAGAZINE

[75] Inventors: Klaus Peter Zuhlsdorff, Cologne, Germany; Paul Schenk, Neuchatel, Switzerland

[73] Assignee: Fa. TONDO-Werk Adolf Noss, Solingen, Germany

[22] Filed: Mar. 8, 1974

[21] Appl. No.: 449,388

[30] Foreign Application Priority Data

| | | |
|---|---|---|
| Mar. 9, 1973 | Switzerland | 3559/73 |
| June 29, 1973 | Germany | 2333101 |
| Jan. 12, 1974 | Germany | 2401398 |

[52] U.S. Cl. ..... 132/40

[51] Int. Cl.[2] ..... A45D 2/00

[58] Field of Search ..... 132/40, 85, 11; 15/159, 15/167, 176, 202, 179

[56] References Cited

UNITED STATES PATENTS

| | | | |
|---|---|---|---|
| 2,344,908 | 3/1944 | Whitman | 132/33 R |
| 2,380,154 | 7/1945 | Dickerson | 132/33 R |
| 2,694,826 | 11/1954 | Blakely | 15/179 |
| 3,416,543 | 12/1968 | Hantman | 132/11 R |
| 3,483,876 | 12/1969 | Planel | 132/33 R |
| 3,755,847 | 9/1973 | Liebscher | 15/176 |
| 3,768,109 | 10/1973 | Wardell | 15/176 |
| R26,766 | 1/1970 | Jorgensen | 132/33 R |

*Primary Examiner*—G. E. McNeill
*Attorney, Agent, or Firm*—Bacon & Thomas

[57] ABSTRACT

A bristle hair curler combination consisting of a set of bristle hair curler elements and a curler handle which is attachable to a curler element by means of axially extending retaining members which directly engage the core of the curler element. A curler magazine serves for the stowage of the curler elements and handle.

14 Claims, 11 Drawing Figures

BRISTLE HAIR CURLER AND HAIR CURLER MAGAZINE

BACKGROUND OF THE INVENTION

1. Field of the Invention

The present invention relates to brush-type or bristle hair curlers, and in particular to bristle hair curlers which are combined with a detachable handle having longitudinally extending retaining fingers capable of holding a hair curler element. The invention further relates to bristle hair curler elements suitable for this purpose and to hair curler magazines for the stowage of a set of such hair curlers.

2. Description of the Prior Art

In the German Gebrauchsmuster (Utility Model) No. 1,928,123 is disclosed a bristle hair curler combination of the above-mentioned type. This prior art combination uses a retaining finger arrangement in which the handle includes several fork-like extending pins or tines, arranged in a circle, which penetrate between the bristles of a cylindrical bristle hair curler, thereby holding the latter. Following the setting of a lock of hair, the handle with its retaining tines is withdrawn, while the bristle curler remains in the rolled lock.

This known bristle hair curler combination is suitable for the rolling of locks, but can not be used for general brushing purposes. Such a hair curler combination, when used for brushing, is subjected to considerable forces on the bristle curler, in which case the engagement between the retaining elements of the handle and the bristles of the hair curler is inadequate to retain the latter on the handle. The result is a shifting of the bristle hair curler on the retaining tines of the handle, followed by detachment of the latter, making the use of this hair curler combination for regular brushing purposes impractical.

SUMMARY OF THE INVENTION

It is a primary objective of the present invention to improve upon the bristle hair curler combination described above in such a manner that it can also be used for regular brushing of the hair, prior to rolling of a lock and detachment of the handle.

In order to attain the above objective, the invention suggests a bristle hair curler having a substantially cylindrical core of firm, stable material which is directly engaged by the retaining members of the handle.

This direct engagement between the handle and the curler core is an improvement over the prior art, where the engagement between the curler and the handle is obtained by engaging the resilient bristles of the former. The direct engagement of the curler core independently of the bristles leaves the curler bristles in their original alignment, while providing a relatively rigid mechanical connection between the curler core and the retaining member, or members, of the handle.

The favorable results outlined above are obtainable even with bristle hair curlers whose cores are of very small diameter. However, in view of certain manufacturing limitations of the bristle covers of the curlers, and because of design limitations reflecting handling convenience, and especially in order to assure a certain minimum rolling radius of the hair locks wound around the curler core, the diameter of the latter should be at least one-fifth of the overall diameter of the bristle hair curler.

In a first embodiment of the invention the retaining members of the handle are similar in their general arrangement to the known prior art handle. These retaining members consist of a plurality of longitudinally extending pins or retaining fingers. The retaining fingers are so arranged that they engage the periphery of the curler core, whereby the latter is firmly engaged by several circumferentially equidistant members, as if confined within a rod cage which is open on one axial end.

A particularly advantageous version of this embodiment suggests a bristle hair curler whose bristles are arranged in the form of longitudinal rows of bristles arranged in regular circumferential spacing so as to define a plurality of axially parallel, longitudinal grooves or flutes which correspond in number and spacing to the retaining fingers of the handle.

The retaining fingers of the curler handle can thus be conveniently introduced into the longitudinal flutes of the hair curler. This combination has the additional advantageous effect that the retaining fingers, when placed between the spaced bristle rows of the hair curler, represent a sort of hair guide in that they limit the penetration of the hair between the curler bristles. This feature is especially desireable for lock rolling, in as much as the innermost hair strands of a lock are maintained at a radial distance from the curler core itself. This feature prevents not only the accumulation of loose hair near the converging inner ends of the curler bristles, it also creates air channels between the curler core and the rolled lock, after the curler handle is detached from the curler. Obviously, these air channels are very desirable, because they permit ventilation of the rolled lock from inside as well as outside. The result is an accelerated and more even drying of the hair, because of its improved accessibility to a drying air stream.

In a second embodiment of the invention the engagement between the bristle hair curler and the curler handle is obtained by means of retaining members which, rather than surrounding the curler core, penetrate into one or several longitudinal cavities arranged inside the curler core.

In a preferred version of this embodiment the retaining member of the handle is provided in the form of a centrally extending mandrell, the curler core having a cooperating central longitudinal cavity into which the mandrell of the handle can be engaged.

This embodiment is particularly advantageous with respect to manufacturing considerations, because both parts can be produced very economically: the handle is preferably injection molded, while the bristle curler core is produced in the form of a plastic extrusion.

Obviously, when used as a brush, the bristle hair curler must not be allowed to rotate with respect to the curler handle. One simple solution to this requirement of non-rotatability is the choice of a non-circular cross section for both the retaining mandrell of the handle and the central cavity of the curler core. Their cross section may, for instance, be square, elliptic, or of some other shape. Alternatively, it is also possible to use a cylindrical mandrell extension on the handle and a plain center bore in the curler core in conjunction with suitable rotation-prevention means, such as a combination of one or several radial noses on the mandrell or handle cooperating with matching recesses in the curler core.

Lastly, the invention suggests a means for frictionally retaining the handle against a bristle hair curler so that a certain limited force is required to detach the handle from the curler element. The purpose of this frictional engagement is to prevent the accidental detachment of the handle from the curler, especially when used for brushing purposes.

A preferred simple embodiment of the frictional engagement between the hair curler and the handle consists, for example, in that the retaining members of the handle and the cooperating engagement surfaces of the curler core are so designed that they are freely movable relative to each other during engagement or disengagement, except for a short length portion ahead of the engagement end position in which the cooperating retaining members and core surfaces are dimensioned for frictional interference so as to produce a clamping effect.

Since considerable forces may have to be withstood by the combination during use as a hair brush, the curler handle may be appropriately shaped to include an enlarged flattened grip portion adjacent to the retaining elements, while the remaining portion of the handle is preferably shaped as a smooth round stem. This handle shape has the advantage that the grip portion can be conveniently seized between two fingers, in order to prevent rotation of the hair curler during brushing, the round stem permitting holding of the curler handle while it rotates during a lock rolling operation.

As part of the novel combination of the bristle hair curler and detachable handle, the invention further suggests a bristle hair curler element or brush, which is generally cylindrical and has a cover of radially extending bristles arranged on a generally cylindrical curler core of firm, stable material, the bristles covering the entire length of the core, but not its end faces.

The proposed curler element itself does not include any grip portion or handle, but constitutes simply a given length portion sliced off a longer brush roll. The curler handle can be directly attached to this type of bristle hair curler, regardless of the length of the latter.

In the embodiment in which the retaining members of the handle engage one or several longitudinal cavities inside the curler core, the previously described advantage of the retaining fingers creating removable spacers for the innermost hair strands of a lock is of course not available. However, a somewhat similar effect is obtainable inspite of the mandrell-type attachment between the curler and the handle, if the curler profile is so modified that it carries on its periphery a pattern of longitudinal bristle rows similar to those described earlier and the core profile includes ridges or ribs extending in the flutes between the bristle rows.

These longitudinal ribs serve as supporting ledges for the innermost hair strands of a lock, thereby limiting the penetration of the hair strands between the bristles, while simultaneously creating longitudinal ventilation channels between the inner ends of the bristle bunches and the longitudinal ridges.

It should be understood that in practically all cases a plurality of hair curler elements is used in conjunction with a curler handle. Such a set of hair curlers may advantageously comprise curler elements of different lengths. Each hair curler is successively attached to the curler handle and, after initial brushing of a given hair lock, is rolled into the latter, in order to produce a desired pattern of hair curls.

The present invention therefore includes among its suggestions a novel hair curler magazine for the stowage of at least one complete set of hair curlers and for the simplification of curler selection and curler attachment to the handle.

For this purpose, the hair curler magazine is so arranged that it presents a number of vertically extending curler supports onto which or into which the bristle hair curler elements can be placed in such a way that the handle can be directly engaged into any selected hair curler, without the need for holding the latter.

Even after the handle is engaged into a particular hair curler element, the combination, though ready for use, does not topple from the magazine, but may be left in this position, if immediate use is not intended. Of course, the curler magazine is preferably of such a size that it accommodates a complete set of bristle hair curler elements, having a separate support for each curler element so that any one of the hair curlers may be chosen for attachment to the handle. Thus, any desired hair curler may be selected out of the curler magazine by merely sticking the handle into the selected hair curler until fully engaged therewith. Withdrawal of the handle then dislodges the hair curler from the magazine, and the curler handle combination is immediately usable for brushing and lock rolling purposes. Thus, the bristle hair curler elements can be removed from the magazine one by one, in a simple operation performable with one hand only.

In a preferred embodiment of the hair curler magazine of the invention the magazine consists of a base which supports a raised surface. On this surface are provided a plurality of cylindrical recesses of a diameter corresponding to the outer diameter of a bristle hair curler element, the recesses being open at their upper end, but having a closed bottom, or at least abutement means on which the inserted curler element is supported.

The depth of each cylindrical recesses may be adapted to the different lengths of the various hair curlers. Preferably, however, they are identical in depth, while the hair curlers protrude from these recesses more or less, depending upon their length. For economical production purposes, the hair curler magazine is preferably injected molded or vacuum-formed in one piece, the base, the raised surface, and the downwardly depending cylindrical recesses being formed from one continuous wall. This type of structure lends itself conveniently for vacuum forming or deep-drawing, using a plastic sheet as raw material. Alternatively, the magazine may also be made of foamed plastic, e.g. polyurethane, in which case the side walls, the bottom of the base, and the upper surface of the magazine are outside walls off a single plastic block.

In an alternate embodiment of the hair curler magazine the curler supporting means are in the form of vertically extending supporting pins engaging a central bore in the curler core. It is of course also possible to provide a plurality of supporting pins engaging the curler core in the manner of the first-described embodiment of the curler handle with its axially extending retaining fingers.

In the base of the curler magazine is preferably also provided an additional recess for the stowage of the curler handle, so that all the component parts of the inventive combination are conveniently combinable in a portable and stowable unit. The unit may in addition have a transparent plastic cover for display and for protective purposes.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows.

DESCRIPTION OF THE PREFERRED EMBODIMENTS

Figures 1, 2, 3, 4, 5, 6, 7:
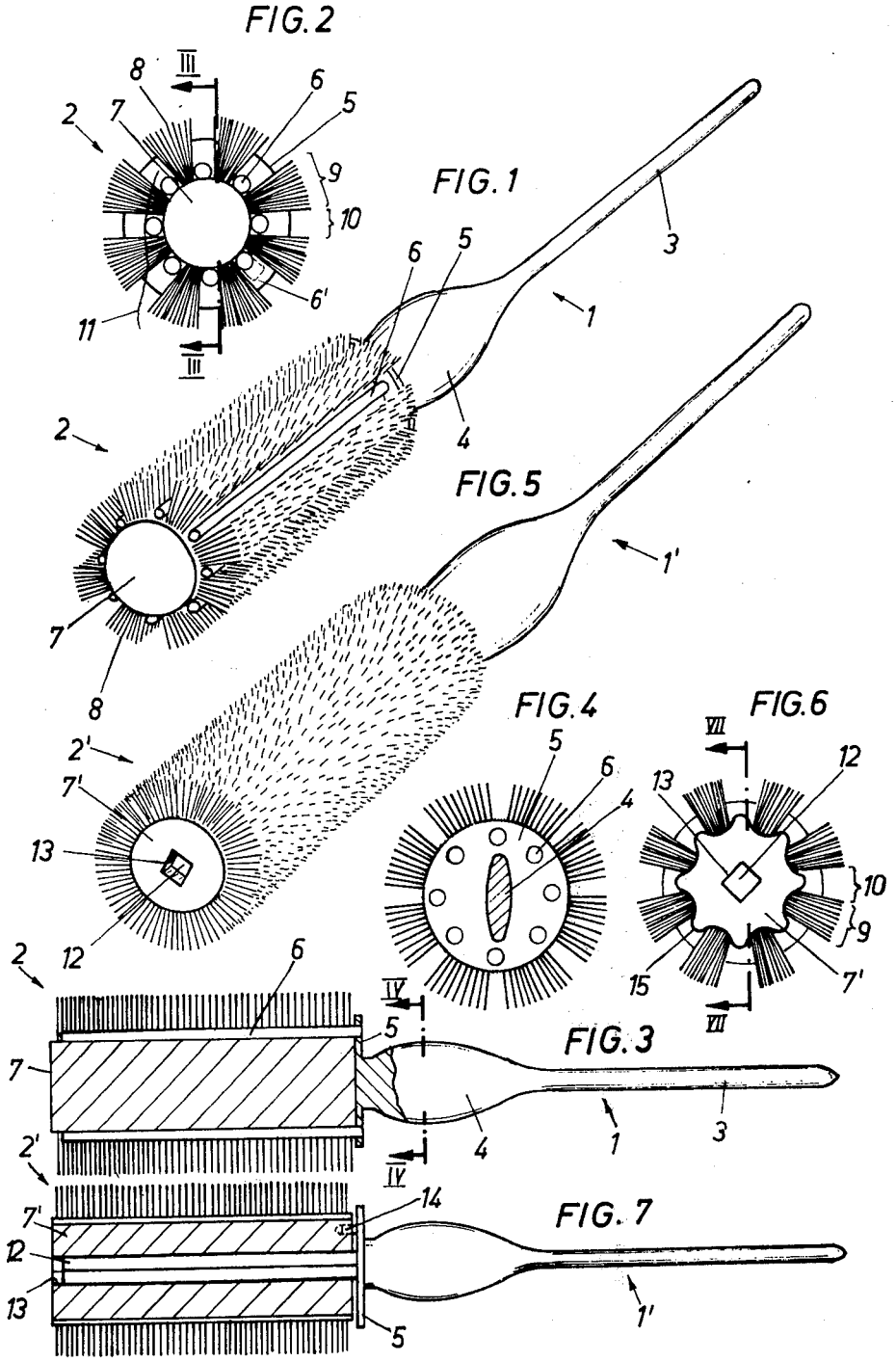
FIG. 1 is a perspective representation of a bristle hair curler combination representing a first embodiment of the invention.
FIG. 2 is an end view of the curler combination of FIG. 1, seen from the side opposite the handle.
FIG. 3 shows the curler combination of FIG. 1, partially in longitudinal cross section.
FIG. 4 is a cross section taken along line IV—IV of FIG. 3.
FIG. 5 is a perspective view of a hair curler combination representing a second embodiment of the invention.
FIG. 6 is an end view of the curler combination of FIG. 5 comparable to FIG. 2.
FIG. 7 is a longitudinal representation similar to FIG. 3, showing the curler core in a longitudinal cross section taken alone line VII—VII of FIG. 6.

In FIGS. 1–4 is illustrated, as a first embodiment of the invention, a hair curler combination comprising a handle 1 and a bristle hair curler 2 attached to the handle in longitudinal alignment therewith. The curler handle 1 includes at its rear portion a stem 3 of approximately round cross section and in its front portion, adjacent to the hair curler 2, an enlarged, flattened grip portion 4, a cross section of which is visible in FIG. 4. Just forward of the grip portion 4 is arranged a circular flange 5 which carries a plurality of parallel, axially extending pins or retaining fingers 6 arranged in regular spacing on the curcumference of a circle. As can be seen in FIG. 1, these retaining fingers have the appearance of a rod cage which is open on its forward end. In the drawing the retaining fingers 6 are in the form of simple pins of round cross section. However, their cross section need neither the round nor uniform, and the retaining fingers may have a rectangular cross section — as implied at 6′ in FIG. 2 of the drawing — and/or the retaining fingers may have a tapered longitudinal outline with their strongest cross section at the flange 5. In each of these two cases the resistance against breakage of the retaining fingers is improved. Lastly, the cross section of the retaining fingers may also be trapezodial or triangular in shape, with the narrow face of the fingers engaging the body of the hair curler, which cross section is most suitable for hair curlers of very small diameter.

The retaining fingers 6 bear directly against the cylindrical core 7 of the bristle hair curler 2. This is possible, because the bristles 8 of the hair curler are arranged in spaced, axially parallel longitudinal rows 9, with longitudinal gaps or flutes 10 defined therebetween for the accommodation of the retaining finger 6. The diameter of the core 7 and the diagonal distance between opposing retaining fingers 6 is preferably such that the fingers 6 exert a slight radial pressure against the core 7 so that the hair curler element 2 is prevented from freely moving between the retaining fingers, possibly falling off. The engagement action of the hair curler element 2 onto the handle 1, and its disengagement therefrom, should therefore require a gentle pushing or pulling force.

In the embodiment of FIGS. 1–4 the retaining fingers 6 also prevent the accumulation of hair debris at the base of the bristles of the curler 2, by serving as deflectors and as rolling supports for the hair strands 11 (FIG. 2), maintaining the latter at a distance from the curler core 7 and hence from the base of the bristles 8. In the absence of such deflecting means, there exists the tendency of some of the hair strands to penetrate deeper and deeper between the bristles 8, until they become jammed between converging bristles, a condition which is very undesirable.

A second embodiment of the invention is illustrated in FIGS. 5–7, in which the curler handle 1′ includes a central retaining mandrell 12 taking the place of the multiple retaining fingers of the earlier embodiment. The mandrell 12 engages a matching central cavity 13 of the curler core 7′, as can be seen in FIG. 7 of the drawing. The engaging and disengaging operations for the handle 1′ and the hair curler element 2′ are generally identical to those of the earlier-described embodiment, the central mandrell 12 engaging the central cavity 13 of the core 7′ in a resilient frictional engagement.

The hair curler cores 7 and 7′ need not be cylindrical in shape. A particularly advantageous example of a cross-sectional profile of a curler core is illustrated in FIG. 6. For the purposes of this disclosure, therefore, the expression "cylindrical" should be understood to include non-circular cross sections, as long as the curler core 7 and 7′ is generally symmetrical in cross section with relation to its longitudinal axis, and its cross section is generally uniform over its entire length.

The bristle hair curler element 2′ shown in FIG. 5 represents a regular, uniform, round brush. However, as can be seen in FIG. 6, the bristles 8 may also be arranged in a pattern of spaced longitudinal bristle rows 9 defining open flutes 10 between them. This arrangement is advantageous when it is desired to obtain a deflecting effect similar to the one described in connection with the retaining fingers 6 of FIG. 2 in the embodiment in which the attachment between the curler element 2′ and the handle 1′ is obtained by means of the central mandrell 12 and the cooperating central cavity 13 of the curler core 7′. This can be accomplished with a curler core cross section which includes raised longitudinal ribs or ridges 15 in the flutes 10 between the bristle rows 9.

In the illustrated example of the second embodiment the central mandrell 12 and the cooperating core cavity 13 have matching square cross sections. It should be understood, of course, that other polygonal cross sections may also be used, or that rounded, non-circular cross sections, such as elliptical shapes, are likewise suitable. In any case, it is important that the rotation of the hair curler element 2′ relative to the curler handle 1′ is prevented. In the foregoing examples, this is achieved by a non-rotatable engagement between the mandrell 12 and the core cavity 13. Alternatively, it may be desired to use a round handle mandrell in conjunction with a plain round central bore in the curler core, in which case additional rotation-prevention means will be required, such as pins 14 on the handle flange 5 engaging cooperating recesses in the curler core 7′ (FIG. 7).

Figure 8:
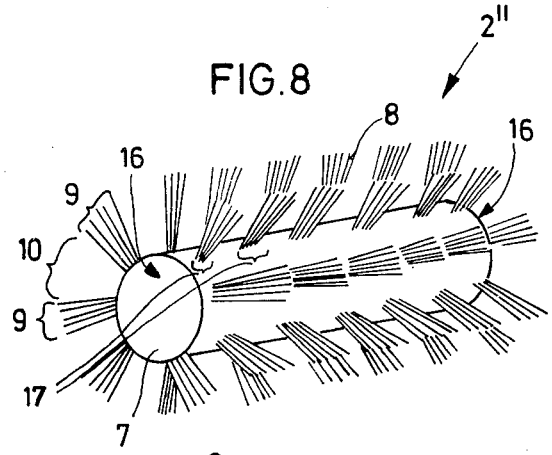
FIG. 8 is a perspective niew of a bristle hair curler element suitable for use in the curler combination of FIG. 1.

FIG. 8 illustrates a single brush or hair curler element 2″ which is shown without a handle. The hair curler element 2″ is again covered by a plurality of radially extending bristles 8 arranged in regularly spaced longitudinal bristle rows 9, with open flutes 10 between them. Each bristle row 9 consists of a succession of separate bristle bunches 17. The end faces 16 of the hair curler core 7 are free of bristles and extend perpendicular to the core axis, as would be obtained by slicing longitudinal sections from a longer length of a round brush or brush roll. A transverse cutting operation for this purpose would take advantage of the longitudinal spacing between the bristle bunches 17, so that the first and last bristle bunches of a row 9 are positioned near an end face 16, without being weakened by the cutting operation. The curler core 7 of this brush assembly is preferably manufactured as a plastic extrusion, into which the bristle bunches 17 are imbedded.

Figure 9:
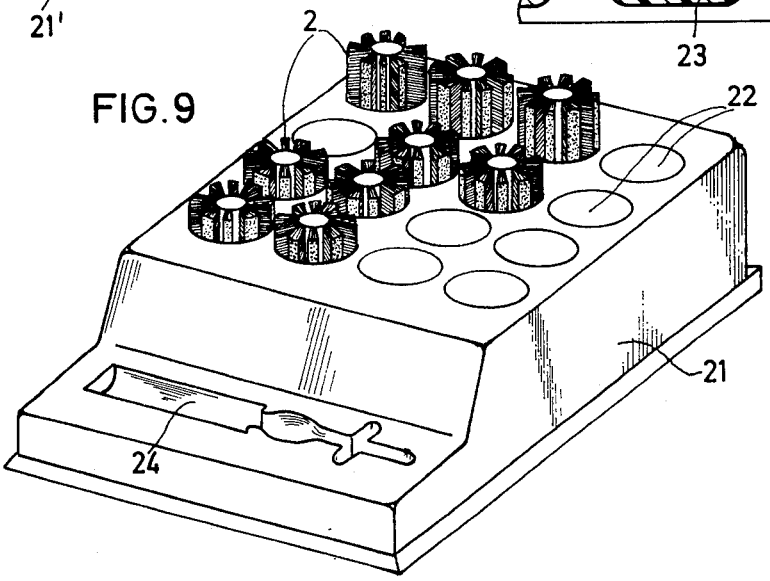
FIG. 9 illustrates in a perspective view a hair curler magazine containing several bristle hair curlers.

In FIG. 9 as illustrated a hair curler magazine 20 for the presentation and stowage of a plurality of bristle hair curler elements 2 of the type described above. A complete hair curler combination, as suggested by the present invention, would thus normally comprise a set of hair curler elements 2 and a single curler handle 1, to which any one of the curler elements can be attached for brushing and lock rolling purposes. The curler magazine 20 is preferably so arranged that the curler elements 2 are held in upright orientation so that the handle 1 can be engaged against a selected curler element without the need for holding the curler element with the other hand.

The illustration of FIG. 9 shows a curler magazine 20 obtained, for example, in a deep-drawing operation from a sheet of plastic material. The magazine has a base portion 21, its overall appearance being comparable to that of a control panel with a raised upper panel surface. In this surface are provided a number of vertical cylindrical recesses 22 of a diameter corresponding to the outer diameter of the hair curler elements 2. As can be seen in the cross-sectional representation of FIG. 10, each recess 22 includes a bottom portion 23 on which a hair curler element 2 is supported. The depth of the recesses 22 is preferably such that the curler elements 2 protrude a distance from the upper surface of the magazine 20.

The magazine 20 further includes an offset forward portion in which is arranged a shaped depression 24 for the stowage of a curler handle 1 or 1′.

Figure 10:
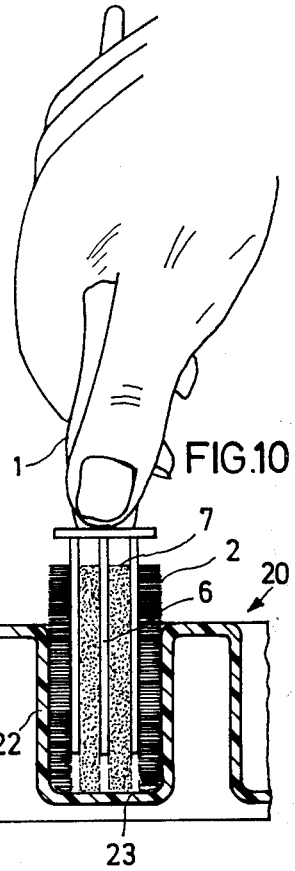
FIG. 10 shows a vertical cross section through a portion of the curler magazine of FIG. 9.

The curler magazine of FIGS. 9 and 10 is intended to be placed on a level surface, with the curler elements 2 oriented vertically. However, it may be desirable to suspend the curler magazine 20 on a wall, in which case the orientation of the recesses 22 has to be modified in such a way that the hair curler elements 2 do not drop out of their recesses.

FIG. 10 further illustrates how it is possible to engage a hair curler element 2 on a curler handle 1, while the curler element 2 remains inside its magazine recess 22. This is accomplished by simply engaging the handle 1 from above into the appropriate flutes 10 (or central cavity 13) of the hair curler element 2, until the two parts are frictionally engaged, after which the attached combination of bristle hair curler and curler handle can be withdrawn from the magazine and used in the intended manner. It is also possible to release the curler handle 1 after engagement against the hair curler element 2, in which case the magazine recess 22 maintains the combination in a ready vertical position, restraining it from falling from the curler magazine 20.

The embodiment illustrated in FIG. 10, in which the curler handle 1 is of the type having a plurality of spaced retaining fingers, shows the fingers 6 in a position just prior to complete engagement with the hair curler element 2. As mentioned earlier, a frictional engagement is provided during the last portion of engagement advance so that the hair curler 2 remains attached to the handle 1 during removal from the magazine 20 and during the manipulations of brushing and lock rolling. Once a hair curler element is imbedded in a rolled lock, the curler handle 1 is laterally withdrawn from the curler 2, by restraining the latter with one hand and by pulling the handle with the other. The curler handle 1 is now reusable with another hair curler element 2.

Figure 11:
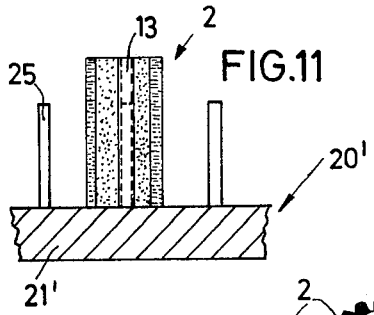
FIG. 11 shows a cross section similar to that of FIG. 10 of a different hair curler magazine.

In FIG. 11 is illustrated an alternative version of a curler magazine 20′ in which the magazine base 21′ is a flat plate carrying on its upper surface a plurality of vertically extending supporting pins 25 on which the hair curler elements 2 are engaged. In this case the curler cores 7 require a central bore, which may be the earlier-mentioned central cavity 13 of core 7. When the handle part of the combination is of the kind shown in FIG. 10, no interference is possible between the supporting pins 25 and the curler magazine 20′. However, in the case of the mandrell-type curler handle 1′, the axial length of both the supporting pins 25 and the mandrell extension 12 have to be shortened accordingly in order to prevent interference, or the engagement operation between the hair curler element 2′ and the handle 1′ has to be changed in such a way that the full engagement is performed with the curler element 2′ removed from the supporting pin 25.

It should be understood, of course, that the foregoing disclosure describes only preferred embodiments of the invention and that it is intended to cover all changes and modifications of these examples of the invention which fall within the scope of the appended claims.

We claim:

1. A bristle hair curler combination comprising:

a generally cylindrical hair curler element having an elongated core with radially oriented bristles attached thereto in the manner of a brush roll, the curler core including a plurality of axially parallel longitudinal engagement surfaces;

a detachable curler handle engaging the hair curler element from one axial end thereof so as to form an axial extension of the curler element;

means defined by the curler handle for frictionally engaging the curler core on several of its engagement surfaces in such a manner that the disengagement of the curler element from the handle requires a predetermined axial pull which is considerably in excess of the weight of the hair curler element; and wherein said core engaging means of the handle includes at least one axially extending retaining member on the handle defining several axially parallel engagement surfaces which are adapted to cooperate with said engagement surfaces of the curler core.

2. A hair curler combination as defined in claim 1, wherein:

the diameter of the curler core is at least one-fifth of the outside diameter of the bristle hair curler element.

3. A hair curler combination as defined in claim 1, wherein:

the engagement surfaces of the curler core and the axially extending retaining member, or members, of the core engaging means of the handle define between them a clamping means for producing said frictional engagement through resilient material interference, the clamping means being arranged on a relatively short length portion of the cooperating engagement surfaces and retaining members and so located axially with respect thereto that it is disengaged first, when the handle is detached from the curler element, and engaged last, when the handle is axially engaged into the curler element.

4. A hair curler combination as defined in claim 1, wherein:

the curler core is substantially cylindrical in shape and of a comparatively firm, stable material;

the bristles on the curler core are arranged in the form of several circumferentially spaced, axially parallel rows of bristles, defining between them an equal number of longitudinal flutes, whereby surface portions of the curler core are exposed at the bottom of each flute which serve as the aforementioned engagement surfaces of the curler core; and the core engaging means of the curler handle icludes a number of spaced parallel retaining fingers extending axially from the handle, the retaining fingers being so arranged that they engage at least several of said engagement surfaces of the curler core.

5. A hair curler combination as defined in claim 4, wherein:

the number of retaining fingers is identical to the number of longitudinal flutes on the bristle hair curler element; and the curler handle includes a flange axially adjacent to the hair curler element, the retaining fingers being attached to said flange and regularly spaced along the circumference of a circle, thereby defining an axially open rod cage.

6. A hair curler combination as defined in claim 1, wherein:

the curler core is of a comparatively firm, stable material and includes at least one axially extending cavity within its cross-sectional profile, said engagement surfaces of the core being defined by the above cavity, or cavities; and the core engaging means of the curler handle includes a cooperating axially extending retaining member having matching longitudinal engagement surfaces provided thereon with which it frictionally engages the aforementioned engagement surfaces of the curler core.

7. A hair curler combination as defined in claim 6, wherein:

the axial cavity inside of the curler core is a centrally located cavity of uniform cross-sectional profile; and the retaining element of the curler handle is a matching centrally aligned retaining mandrell engaging said central core cavity.

8. A hair curler combination as defined in claim 7, wherein:

the cross-sectional profiles of the core cavity and of the retaining mandrell are non-circular in outline, thereby preventing rotational movement of the hair curler element relative to the handle.

9. A hair curler combination as defined in claim 1, wherein:

the curler handle further includes an enlarged, flattened grip portion axially adjacent to its core engaging means and a stem of round cross section pointing axially away from said grip portion and from the hair curler element.

10. A bristle hair curler adapted for attachment to a curler handle, comprising in combination:

a generally cylindrical core of comparatively firm, stable material;

radially extending bristles attached to the core in the manner of a brush roll and covering the surface of the latter from end to end;

a planar, bristle-free end face on each axial end of the core; and wherein said bristles are attached to the core in such a pattern that they define on the circumference of the core a plurality of angularly spaced, axially parallel, narrow longitudinal flutes which are free of bristles.

11. A hair curler as defined in claim 10, wherein:

the diameter of the core is at least one-fifth of the outside diameter of its bristle cover.

12. A hair curler as defined in claim 10, wherein:

the bristle pattern includes a succession of longitudinal rows of bristles, with said longitudinal flutes arranged between them; and the core includes a longitudinal raised ridge in each of said flutes, the height of the ridges being a fraction of the free bristle length.

13. A hair curler as defined in claim 10, wherein:

the core includes at least one axially extending cavity within its cross-sectional profile.

14. A hair curler as defined in claim 13, wherein:

the core includes a central cavity extending axially therethrough, said central cavity having a non-circular cross-sectional outline.

* * * * *